US005411098A

United States Patent [19]

Schmidt et al.

[11] Patent Number: 5,411,098

[45] Date of Patent: May 2, 1995

[54] METHOD OF STIMULATING GAS-PRODUCING WELLS

[75] Inventors: Joseph H. Schmidt, Anchorage, Ak.; Dennis R. Reimers, Farmington, N. Mex.

[73] Assignee: Atlantic Richfield Company, Los Angeles, Calif.

[21] Appl. No.: 149,579

[22] Filed: Nov. 9, 1993

[51] Int. Cl.[6] ..... E21B 43/00

[52] U.S. Cl. ..... 166/369; 166/256

[58] Field of Search ..... 166/256, 257, 259, 265, 166/266, 268, 269, 369, 370, 305.1, 308

[56] References Cited

U.S. PATENT DOCUMENTS

| | | | |
|---|---|---|---|
| 3,565,171 | 2/1971 | Closmann | 166/256 X |
| 3,580,336 | 5/1971 | Meldau | 166/256 X |
| 4,109,719 | 8/1978 | Martin et al. | 166/259 |
| 4,245,699 | 1/1981 | Steeman | 166/271 |
| 4,305,464 | 12/1981 | Masszi | 166/370 |
| 4,422,505 | 12/1983 | Collins | 166/256 |
| 4,683,947 | 8/1987 | Fernbacher et al. | 166/256 X |
| 4,995,463 | 2/1991 | Kramm et al. | 166/308 |
| 5,147,111 | 9/1992 | Montgomery | 299/16 |
| 5,199,766 | 4/1993 | Montgomery | 299/5 |
| 5,297,631 | 3/1994 | Gidson | 166/305.1 X |

OTHER PUBLICATIONS

SPE/DOE/GRI 12843 –"Cavity Stress Relief Method to Stimulate Demethanation Boreholes"; by A. K. Alain and G. M. Denes, 1984, Society of Petroleum Engineers.

*Primary Examiner*—Michael Powell BUiz
*Attorney, Agent, or Firm*—Michael E. Martin

[57] ABSTRACT

Subterranean mineral seams, such as coal, which have been penetrated by gas production wells are stimulated to produce additional gas by placing a liquid, such as a solvent for coal, in the wellbore and in communication with a tubing extending within the wellbore and having a frangible shear disk assembly disposed therein. Pressure is increased inside the tubing string by pumping gas and/or liquid into the tubing string in sufficient quantity to cause the shear disk to release fluid pressure to act on the fluid in the open hole wellbore portion so that a substantial pressure pulse is exerted on the coal seam to effect rubblization of the coal to form a cavity and release entrapped or adsorbed gas for production up through the well. Imposition of rapid and cyclic pressure pulses on the coal seam at pressures up to 5000 psi above the in situ stress improves production of gas therefrom.

10 Claims, 1 Drawing Sheet

METHOD OF STIMULATING GAS-PRODUCING WELLS

BACKGROUND OF THE INVENTION

1. Field of the Invention

The present invention pertains to a method of generating a cavity in a subterranean mineral seam, such as coal, and producing gas from a degasification well using rapid hydraulic pressurization of the coal seam in the vicinity of the wellbore.

2. Background

Certain subterranean mineral seams, such as coal, produce relatively large volumes of hydrocarbon gases through wells which have been drilled into the seam. Various techniques have been used to stimulate the production of gases, primarily methane, from underground coal seams. U.S. Pat. No. 4,995,463, issued Feb. 26, 1991 to Kramm, et al, and assigned to the assignee of the present invention, describes a fracturing technique wherein the coal seam is hydraulically fractured using a water-based fracturing fluid with a wetting agent for converting the coal fines which are formed during the fracturing of the coal to a hydrophilic state and dispersing the fines throughout the fracturing fluid volume. U.S. Pat. No. 5,147,111, issued Sep. 15, 1992 to Carl T. Montgomery, and assigned to the assignee of the present invention, describes a method of improving methane production from a well drilled into a coal seam wherein liquid carbon dioxide is pumped into the well and the pressure generated in the well is quickly released to cause the coal in the vicinity of the wellbore to fragment and generate a cavity in the coal seam. Still further, U.S. Pat. No. 5,199,766, issued Apr. 6, 1993 to Carl T. Montgomery, and also assigned to the assignee of the present invention describes a cavity induced stimulation of coal degasification wells using certain solvents which are forced into the coal seam in the vicinity of the wellbore for a sufficient period of time to weaken the coal structure wherein high pressure gas is then injected into the seam and the pressure is suddenly released to effect disintegration of the coal around the wellbore.

However, in a continuing effort to improve the effectiveness of coal degasification wells while pursuing relatively uncomplicated methods to increase gas production from these wells, another method has been developed which has certain advantages in producing a larger volume of fragmented coal and releasing greater volumes of adsorbed gas. It is to this end that the present invention has been developed with a view to providing a unique, uncomplicated method for stimulating the production of gas from coal degasification wells and the like.

SUMMARY OF THE INVENTION

The present invention pertains to an improved method of stimulating the production of gas, primarily methane, from subterranean coal seams into which a gas production well has been drilled and wherein the coal seam intersected by the wellbore is subjected to relatively high hydraulic pressures which are produced rapidly and allowed to decay rapidly to effect greater fragmentation of the coal in the vicinity of the wellbore.

In accordance with an important aspect of the present invention, a coal seam intersected by a wellbore is subjected to substantial and rapidly increasing compressive stresses induced by a fluid which is pumped into the wellbore and which undergoes a rapid increase in pressure followed by a rapid decrease in pressure to effectively induce a stress pulse on the coal seam which improves fragmentation of the coal and stimulates the flow of hydrocarbon gases entrapped in the coal. The fluid pressure pulse is provided by filling the wellbore with a relatively incompressible fluid, placing a closure member in a conduit extending into the fluid, pressurizing the conduit and effecting a sudden opening of the closure member to cause a sudden rise in fluid pressure acting on the coal seam to exert a substantial and sudden increase in compressive stress in the coal and then releasing the pressure of the fluid acting on the coal suddenly to effect a pressure pulse characteristic which will augment the disintegration of the coal surrounding the wellbore.

Those skilled in the art will further appreciate the advantages and superior features of the invention upon reading the detailed description which follows in conjunction with the drawing.

DESCRIPTION OF A PREFERRED EMBODIMENT

Figure 1:
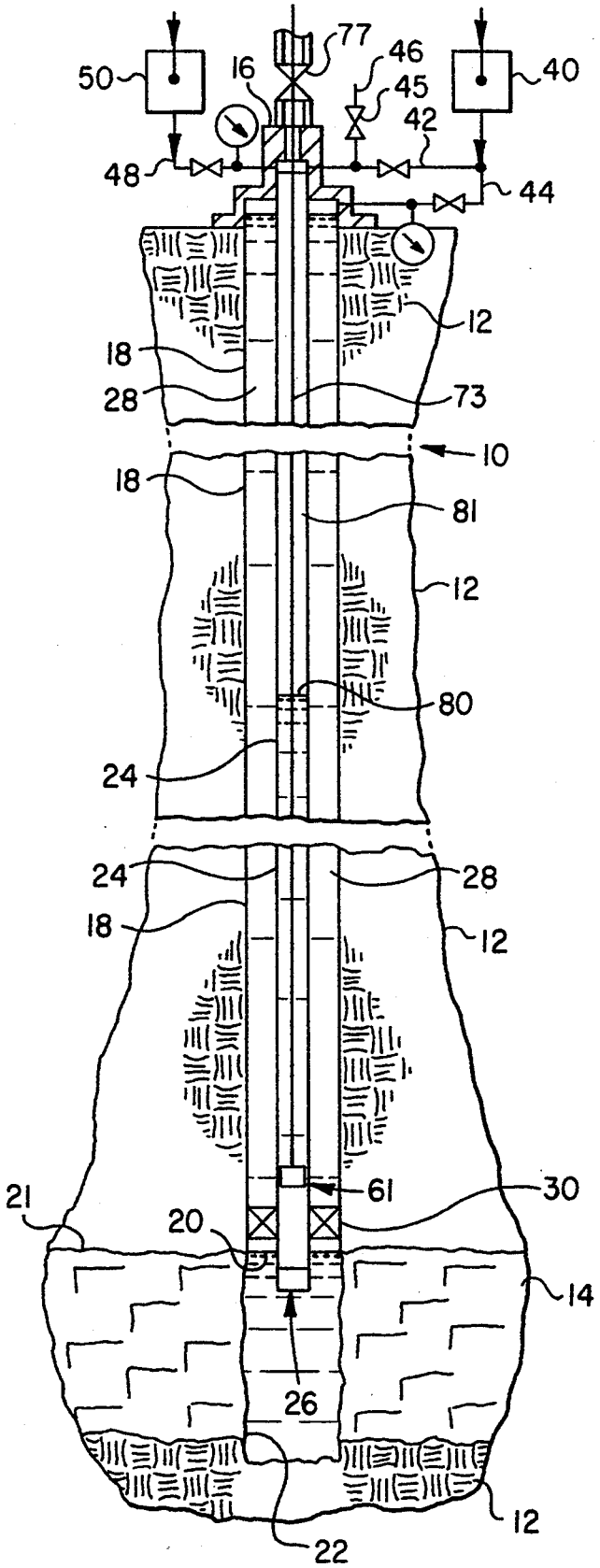
FIG. 1 is a schematic diagram of a coal degasification well penetrating a subterranean coal seam and utilizing the method of the present invention.

In the description which follows, like parts are marked throughout the specification and drawing with the same reference numerals, respectively. The drawing figures are not necessarily to scale and certain elements are shown in generalized or somewhat schematic form in the interest of clarity and conciseness.

Referring now to FIG. 1, there is illustrated a coal degasification or gas production well, generally designated by the numeral 10, which has been drilled through an earth formation 12 into a subterranean coal seam 14. The well 10 includes a conventional wellhead 16 from which extends a generally cylindrical casing 18 having a lower distal end 20 which is disposed essentially adjacent the upper boundary 21 of the coal seam 14. An open hole wellbore portion 22 extends through the portion of the coal seam 14 desired to be degasified or produce hydrocarbon gases.

In one preferred arrangement of the well 10, an elongated conduit or tubing string 24 extends through the casing 18 and terminates at a lower distal end 26 which opens into the open hole wellbore portion 22. The distal end 26 of the tubing string may be characterized as a conventional so-called landing nipple of a type commercially available and which is adapted to releasably receive an insert to be described in further detail herein. The open hole wellbore portion 22 may be isolated from an annular wellbore portion 28 by a conventional releasable packer 30 which forms a fluid tight seal between the annular space 28 and the wellbore portion 22.

Fluids are communicated to the annular space 28, the tubing 24 and the wellbore portion 22 by way of a pump 40 which is operable to be in communication with both the tubing string 24 and the annular space 28 by way of respective flowlines 42 and 44. Fluid may be vented from the wellbore space 22 and the tubing 24 by way of a flow line 46. Each of the flowlines 42, 44 and 46 have suitable closure valves interposed therein. Other fluid such as nitrogen gas, for example, may also be communicated to the tubing string 24 by way of a flowline 48 connected to a suitable compressor 50 and also having a suitable closure valve interposed therein, as shown.

Figure 2:
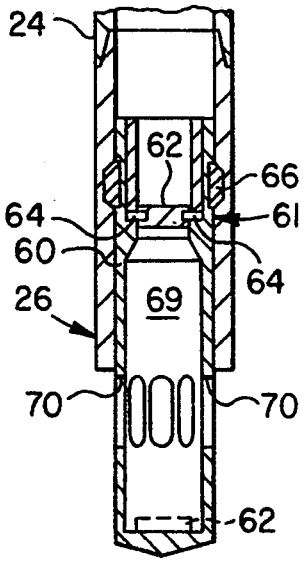
FIG. 2 is a detail view showing one embodiment of a frangible closure useful with the well structure and method of the present invention.

Referring now to FIG. 2, the landing nipple 26 disposed as the distal end of the tubing string 24 is shown with a removable insert interposed therein comprising a very rapid opening type closure device. In particular, the closure device comprises a tubular support member 60 for a frangible closure disk 62 which is interposed in a bore of the support member and is retained in place by suitable opposed shear pins 64. The support member 60 is provided with suitable locking members 66 which may register with corresponding grooves formed in the landing nipple 26 to releasably lock the support member 60 in the position shown in FIG. 2. Upon failure of the shear pins 64, the frangible closure disk 62 may move from the position shown to an alternate position to release the flow of fluid through the tubing string 24 and the interior space 69 of the support member and out through ports 70 formed in the support member. The support member 60 and the frangible closure disk 62 are part of a shear disk assembly generally designated by the numeral 61. FIG. 1 shows the shear disk assembly 61 being lowered into position in the tubing string 24 by a conventional wireline 73 which is operable to be disposed in the interior of the tubing string 24 for moving the shear disk assembly into and out of its position at the distal end of the tubing string 24 through a suitable wireline insertion device or so-called lubricator, generally designated by the numeral 77 in FIG. 1.

The aforedescribed shear disk assembly 61 and several components of the well structure for the well 10 are described in U.S. patent application Ser. No. 07/874,159, filed Apr. 27, 1992 to Joseph H. Schmidt, et al, and assigned to the assignee of the present invention. The '159 application is directed to a technique for hydraulically fracturing an earth formation through a well to stimulate the production of hydrocarbon fluids.

The stimulation of the coal seam 14 to produce hydrocarbon gases therefrom is carried out in accordance with the present invention by filling the wellbore portion 22 and a portion of the tubing string 24 up to a predetermined level 80, see FIG. 1, with a suitable fluid. Such a fluid, primarily a liquid, may include that which is described in U.S. Pat. No. 4,995,463 comprising a water-based fracturing fluid including a wetting agent for converting the coal fines which are formed during the generation of rubblized coal in the wellbore portion 22 from their natural hydrophobic state to a hydrophilic state and a dispersant for dispersing the hydrophilic fines in the fluid. The wetting agent may comprise a surfactant having a hydrophilic portion comprising between about 4 and 40 ethylene oxide units and the dispersant may comprise a surfactant having a hydrophilic portion comprising between about 40 and 150 ethylene oxide units. The water-based solution may be formed by mixing a gelling agent such as a cross-linkable guar gel with water and the wetting agent may include a polyalkyleneoxide nonionic surfactant.

The method of the present invention contemplates that the fluid occupying the wellbore space 22 and the tubing string 24 up to the level 80 may be characterized as a solvent which will comminute the coal in accordance with the method described in U.S. Pat. No. 5,199,766. This solvent may include ammonium hydroxide ($NH_4OH$), ammonia ($NH_3$), nitric acid ($HNO_3$), sulfuric acid ($H_2SO_4$), methyl sulfonic acid ($CH_3SO_3H$), and trifluoracetic acid ($CF_3CO_2H$). These materials are believed to be useful at ambient conditions, that is, they do not require application of additional heat or extreme pressures to function as solvents for coal.

Still further, the method of the present invention contemplates that the fluid placed in the wellbore space 22 and occupying the wellbore space and the tubing string 24 up to the level 80 may comprise liquid carbon dioxide. An advantage of liquid carbon dioxide is that, at the pressure and temperature conditions in the wellbore space 22 expected in many instances, the liquid carbon dioxide will vaporize to maintain a suitably high pressure during the execution of the method and that, as the fluid pressure pulse is imposed on the coal seam, any drop in pressure experienced in the wellbore space 22 and the tubing string will result in more vaporization of the liquid carbon dioxide to occupy the expansion space in the wellbore as the fluid is driven into the coal seam. The volatility of liquid carbon dioxide at the pressure and temperature conditions experienced in many coal degasification wells will advantageously assist in carrying out the method contemplated by the present invention.

These aforementioned liquids may be pumped down through the tubing string 24 to occupy all of the wellbore portion 22 up to the packer 30 as well as at least a portion of the tubing string up to the level 80 indicated in FIG. 1. Another suitable liquid may be pumped into the annular space 28 to fill the total annulus area between the packer 30 and the wellhead 16 to minimize the stresses on the tubing string 24 when pressure is applied within the tubing string as will be described in further detail herein. By pressurizing the annular space 28, higher pressures may be generated in the tubing string 24 than can be generated in either the casing 18 or the tubing string alone.

It is contemplated that with the wellbore space 22 and at least a portion of the tubing string 24 occupied by one of the aforementioned liquids, by way of example, that additional pressure may be applied within the tubing string 24 by pumping a pressure gas into an accumulator space 81 formed in the tubing string between the liquid level 80 and the wellhead 16 until a suitable pressure is accumulated within the tubing string and which is delimited by the failure limit of the frangible closure 62, that is the shearing of the pins 64. Alternatively, additional liquid may be pumped into the accumulator space 81 to compress gas entrapped therein. Heretofore, it has been contemplated, in accordance with the prior art methods of generating an enlarged cavity from the wellbore 22 into the coal seam 14, that the cyclic application of pressure against the coal seam through the wellbore space 22 by pressure gas, up to about 1500 psig to 2000 psig, will effect sloughing of the coal into the wellbore and liberate more entrapped or adsorbed hydrocarbon gases from the coal for production up through the well.

Conversely, the method of this invention contemplates generating much higher pressures, at least momentarily, and then releasing those pressures quickly to provide a significant pressure "pulse" acting on the coal seam to effect greater sloughing or rubblizing of the coal in the vicinity of the wellbore 22 and the release of significant amounts of hydrocarbon gases to be produced through the well 10. By setting the failure pressure of the shear disk 62 at about 5000 to 6000 psig above the in situ compressive stress in the seam, for example, a substantial pressure pulse may be imposed on the coal seam 14 at the surfaces of the seam which define the wellbore portion 22.

With a suitable quantity of one of the aforementioned liquids occupying the wellbore space 22 and at least a portion of the tubing string 24, the shear disk assembly 61 is placed in the position shown in FIG. 2 at the distal end of the tubing string 24 and pressure is increased in the tubing string by pumping gas, under pressure, into the tubing String by way of the compressor 50. Alternatively, the pump 40 is operated to pump additional quantities of liquid into the tubing string 24 to compress a quantity of gas in the tubing string until the pressure in the tubing string reaches the predetermined level set by the configuration of the shear disk 62 and its support pins 64.

When the pins 64 fail, the pressurized fluid in the tubing string 24 will be released to act on the fluid in the wellbore space 22 to transmit a substantial pressure pulse to the coal seam 14 and to drive at least some of the liquid into the coal seam. Once the maximum pressure value is reached in the wellbore 22, the valve 45, FIG. 1, for example, may be opened rapidly to allow the fluid pressure in the tubing string 24 and the wellbore portion 22 to be rapidly released or "blown down" whereby the portions of the coal seam 14 surrounding the wellbore portion 22 will undergo the cyclic stress described above and effect sloughing off of coal particles into the wellbore portion 22, thereby releasing substantial quantities of gas into the wellbore.

It may be necessary to evacuate some coal from the wellbore portion 22 up through the tubing string 24. This may be carried out by inserting a coiled tubing string down through the tubing string 24, after removal of the shear disk assembly 61 from the tubing string, and circulating a suitable carrier liquid through the wellbore portion 22 so that coal particles may be removed up through the tubing string 24. Alternatively, the packer 30 may be released and, together with the tubing string 24, withdrawn from the well followed by insertion of another tubing string into the well and the pumping of a suitable evacuation fluid either through that tubing string or through the annulus 28 to circulate the coal particles out of the wellbore portion 22.

The high-pressure pulse type stimulation of the well 10 as described above may be repeated any number of times as required to produce a suitable amount of gas from the coal seam 14. The application of the pressure pulse may be repeated several times before evacuation of any coal particles is required to enable enlargement of the cavity 22, or the cavity may be evacuated of coal particles after each pressure pulse or the cavity may be formed with the coal particles remaining in situ.

The method of imposing hydraulic pressure on the coal seam may be carried out with a cased well extending into the coal seam. All or part of the wellbore may comprise the accumulator space which is subjected to increased pressure. Pressure fluid may be released into the coal seam by perforation of the casing to release the fluid in the wellbore to act on the coal seam.

Although preferred embodiments of the present invention have been described in certain detail herein, those skilled in the art will recognize that various substitutions and modifications may be made to the invention without departing from the scope and spirit of the appended claims.

What is claimed is:

1. A method of stimulating a subterranean coal seam to produce fluids therefrom and into which a wellbore has been drilled, comprising:

filling at least a portion of said wellbore penetrating said coal seam with a fluid;

providing an accumulator space operable to be in communication with said portion of said wellbore through a rapid opening closure;

providing a fluid in said accumulator space and increasing the pressure of said fluid in said accumulator space with said closure in a closed position; and causing said closure to open rapidly to transfer the fluid pressure in said accumulator space into said portion of said wellbore to generate a pressure pulse acting on said coal seam.

2. The method set forth in claim 1 including the step of:

rapidly relieving the pressure of the fluid in said portion of said wellbore upon generating said pressure pulse to effect a cyclic stress acting on said coal seam which will be sufficient to fragment at least some coal to effect production of fluids entrapped in said coal seam into said wellbore.

3. The method set forth in claim 2 wherein:

the step of providing said accumulator space comprises providing a tubing string extending into said wellbore and having said closure disposed at a distal end thereof.

4. The method set forth in claim 3 wherein:

said closure is provided as a frangible member operable at a predetermined pressure acting thereon to release the fluid pressure in said accumulator space to act on the fluid disposed in said portion of said wellbore.

5. The method set forth in claim 1 wherein:

the fluid in said portion of said wellbore comprises a solvent for coal.

6. The method set forth in claim 1 wherein:

the fluid in said portion of said wellbore comprises liquid carbon dioxide.

7. The method set forth in claim 1 wherein:

at least some of said fluid in said accumulator space is a gas and the step of effecting an increase in the pressure of fluid in said accumulator space is carried out by pumping liquid into said accumulator space to increase the pressure of said gas disposed in said accumulator space.

8. The method set forth in claim 1 or 6 wherein:

the pressure of fluid in said accumulator space is increased to a value of about 5000 psi to 6000 psi above the in situ stress in said coal seam adjacent said wellbore.

9. A method of stimulating a subterranean mineral seam to produce fluids therefrom and into which a well has been drilled, comprising:

filling at least a portion of said well with a fluid;

providing an accumulator space operable to be in communication with said portion of said well;

providing a fluid in said accumulator space and increasing the pressure of said fluid in said accumulator space; and causing the fluid pressure in said accumulator space to act on said fluid in said portion of said well to generate a pressure pulse acting on said mineral seam.

10. The method set forth in claim 9 including the step of:

rapidly relieving the pressure of said fluid in said portion of said well upon generating said pressure pulse to effect a cyclic stress acting on said mineral seam which will be sufficient to fragment at least some portion of said mineral seam to effect production of fluids entrapped in said mineral seam into said well.

* * * * *